United States Patent [19]

Wood

[11] Patent Number: 4,465,181

[45] Date of Patent: Aug. 14, 1984

[54] ARTICLE CARRIER

[75] Inventor: Prentice J. Wood, Atlanta, Ga.

[73] Assignee: The Mead Corporation, Dayton, Ohio

[21] Appl. No.: 517,573

[22] Filed: Jul. 27, 1983

[51] Int. Cl.[3] ..... B65D 5/46; B65D 5/48

[52] U.S. Cl. ..... 206/188; 206/193

[58] Field of Search ..... 206/188, 170, 175, 180, 206/184, 192, 193

[56] References Cited

U.S. PATENT DOCUMENTS

| | | | |
|---|---|---|---|
| 3,402,872 | 9/1968 | Forrer | 206/170 |
| 3,572,543 | 3/1971 | Forrer | 206/188 |
| 3,754,680 | 8/1973 | Wood | 206/188 |
| 3,857,483 | 12/1974 | Wood | 206/188 |
| 4,029,205 | 6/1966 | Wood | 206/188 |

*Primary Examiner*—Joseph Man-Fu Moy

*Attorney, Agent, or Firm*—Rodgers & Rodgers

[57] ABSTRACT

An article carrier of the basket style comprises a bottom wall, a pair of side walls foldably joined respectively to the side edges of said bottom wall, end wall panels foldably joined respectively to the end edges of said side walls and extending inwardly therefrom, medial panels foldably joined respectively to the medial edges of said end wall panels at each end of the carrier and extending inwardly therefrom and being wider than said end wall panels, handle structure joined to the upper portions of said medial panels, a transverse partition panel struck from and foldably joined to each of said medial panels, the transverse partition panels at one end of the carrier being initially disposed in a coplanar relationship with their associated medial panels respectively and the transverse partition panels at the other end of the carrier being swung out of the planes of their associated medial panels respectively through angles of approximately 180° when the carrier is collapsed so that when the carrier is set up both transverse partition panels fold through angles of approximately 90° into set up condition, and an anchoring tab struck from each of said transverse partition panels and joined thereto remote from the associated medial panel and being adhered to the associated side wall.

13 Claims, 6 Drawing Figures

ARTICLE CARRIER

TECHNICAL FIELD

This invention relates to article carriers which are economical to produce and which are of the basket style.

BACKGROUND ART

Known article carriers of the basket style such as that disclosed in U.S. Pat. No. 3,400,856 utilize transverse partition panels having associated anchoring tabs which are struck from cross partition panels.

Article carriers of the type disclosed in U.S. Pat. No. 3,104,027 utilize transverse partition panels and associated anchoring tabs which are struck in part from medial partition panels and in part from cross partition panels.

These known carriers are costly to produce because they utilize a substantial amount of material such as paperboard.

DISCLOSURE OF THE INVENTION

By this invention in one form, an economical article carrier is provided which utilizes transverse partition panels and their associated anchoring tabs which are struck entirely from medial panels at each end of the carrier blank. Because of this, carriers are formed from blanks which are substantially less in their transverse dimensions than are carrier blanks of the prior art.

According to a feature of the invention, auxiliary panels which are foldably joined to the top edges of medial panels on one side of the carrier are folded downwardly and into positions overlying a portion of the apertures formed in the medial panels due to striking therefrom of transverse partition panels.

In accordance with another feature of the invention, a filler panel is foldably joined to a bottom edge of one of the medial panels at one end of the blank and an auxiliary filler panel is foldably joined to a side edge of the filler panel and is arranged in flat face contacting relation therewith and when assembled the filler and auxiliary filler panels bridge the gap between the inner edges of the medial panels and thus constitute a means of substantially strengthening the carrier structure.

BRIEF DESCRIPTION OF THE DRAWINGS

In the drawing

FIGS. 2, 3 and 4 depict intermediate stages of gluing and folding operations through which the blank of FIG. 1 is manipulated

BEST MODE OF CARRYING OUT THE INVENTION

Figure 1:
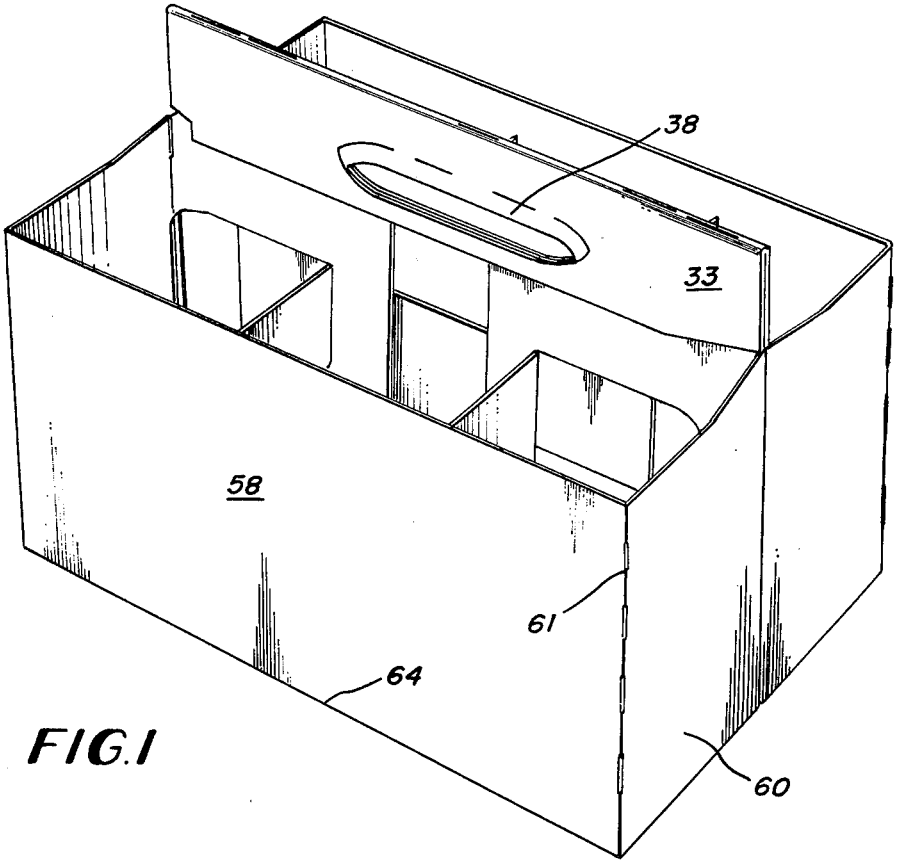
FIG. 1 is a perspective view of a set-up carrier formed according to this invention.

In the drawings, the numeral 1 generally designates a bottom wall of the carrier in which a medial fold line 2 is formed. Bottom wall 1 is foldably joined along fold line 3 to the bottom edge of side wall 4. End wall panels 5 and 6 are foldably joined to the end edges of side wall 4 along fold lines 7 and 8 respectively. Medial panel 9 is foldably joined to end wall panel 5 along a fold line 10 while medial panel 11 is foldably joined to end wall panel 6 along fold line 12.

According to a feature of this invention substantial material saving is achieved because transverse panels 13 and 14 as well as their associated anchoring tabs 15 and 16 respectively are struck entirely from medial panels 9 and 11 respectively rather than from cross partition panels thereby reducing the blank width. Transverse partition panel 13 is foldably joined to medial panel 9 along fold line 17 while transverse partition panel 14 is foldably joined to medial panel 11 along fold line 18. Anchoring tab 15 is foldably joined to transverse partition panel 13 along fold line 19 while anchoring tab 16 is foldably joined to transverse partition panel 14 along fold line 20.

According to other features of the invention filler panel 21 is foldably joined to the bottom edge of medial panel 11 along fold line 22 and auxiliary filler panel 23 is foldably joined to filler panel 21 along vertical fold line 24 and auxiliary panel 25 is foldably joined to medial panel 9 along diagonal fold line 26 while auxiliary panel 27 is foldably joined to medial panel 11 along diagonal fold line 28.

On the other side of the blank, medial panel 29 is foldably joined along its top edge to the top edge of medial panel 9 along fold line 30 while medial panel 31 is foldably joined along its top edge to the top edge of medial panel 11 along the fold line 32.

Outer handle panel 33 is foldably joined at one end to medial panel 31 along fold line 34 and to outer handle panel 35 along medial fold line 36. Handle panel 35 is foldably joined at one end to medial panel 11 along fold line 37. Hand gripping flaps 38 and 39 are foldably joined to handle panels 33 and 35 respectively along fold lines 40 and 41. Inner handle panel 42 is foldably joined to an end edge of outer handle panel 33 along fold line 43 and inner handle panel 44 is foldably joined to inner handle panel 42 along medial fold line 45. Securing tab 46 is foldably joined to outer handle panel 35 along fold line 47.

Transverse partition panel 48 is struck from medial panel 29 and is foldably joined thereto along fold line 49 and is provided with an anchoring tab 50 foldably joined to transverse partition panel 48 along fold line 51. On the other side of the blank, transverse partition panel 52 is struck from and foldably joined to medial panel 31 along fold line 53 and anchoring tab 54 is struck from medial partition panel 52 and is foldably joined thereto along fold line 55.

End wall panel 56 is foldably joined along its edge 57 to medial panel 29 and to side wall panel 58 along fold line 59. End wall panel 60 is foldably joined to the end edge of side wall 58 along fold line 61 and to the side edge of medial panel 31 along fold line 62.

A glue flap 63 is foldably joined to the bottom edge of side wall 58 along a fold line 64.

Figure 2:
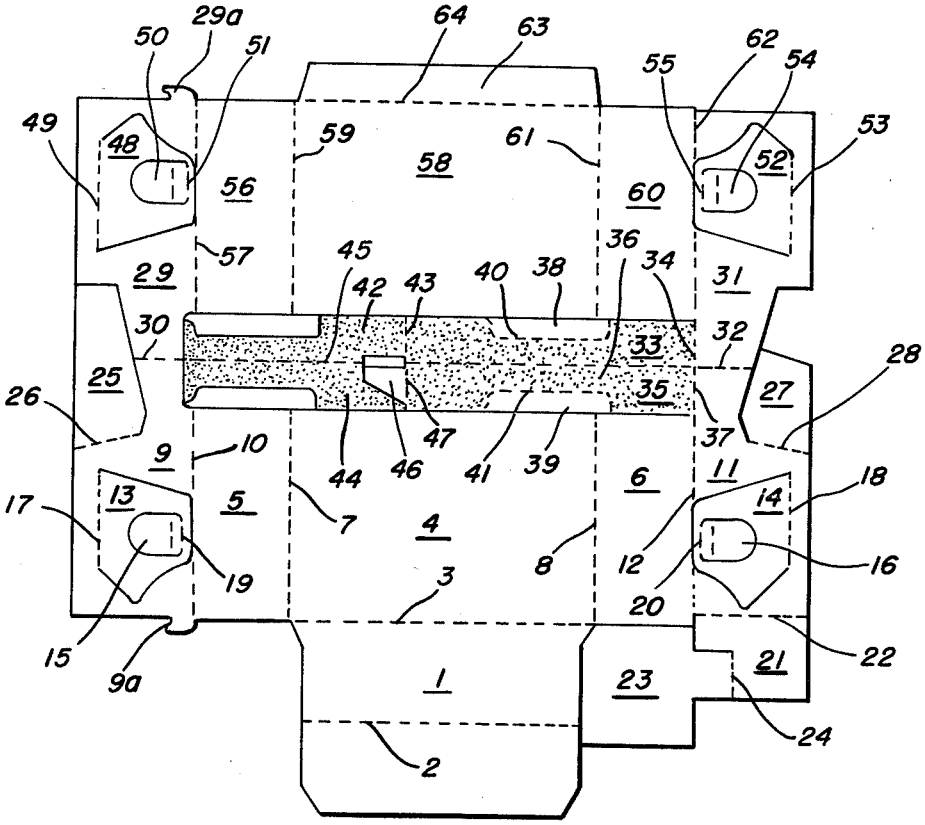
FIG. 2 is a plan view of the inside surface of a blank from which the carrier of FIG. 1 is formed.

To form the carrier, an application of adhesive is made to the blank as indicated by stippling in FIG. 2.

Figure 3:
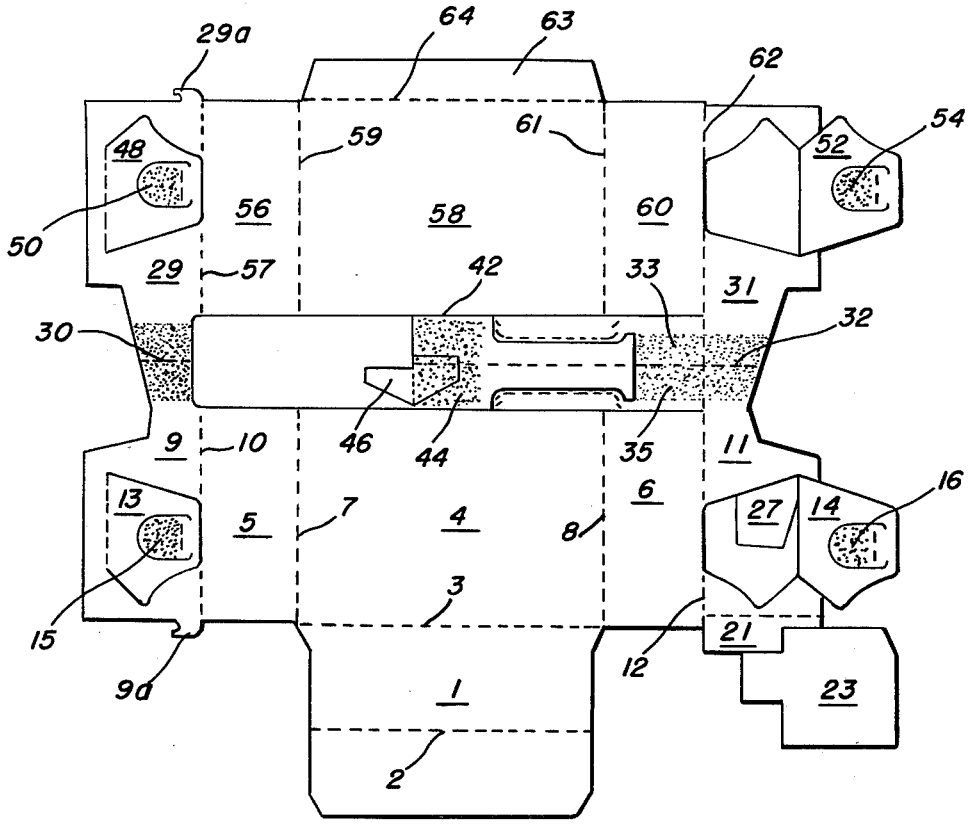

The first folding stage in the formation of the carrier is shown in FIG. 3 from which it is apparent that auxiliary panels 25 and 27 have been folded downwardly and underneath their associated medial panels 9 and 11 respectively along fold lines 26 and 28. In addition transverse partition panels 14 and 52 have been lifted upwardly and folded to the right along their respective fold lines 18 and 53 and the auxiliary filler panel 23 has been elevated and folded to the right along its fold line 24. Inner handle panels 42 and 44 are elevated and folded to the right along fold line 43 to cause the glued panels 42 and 44 to come into coincidence with the inner surfaces of outer handle panels 33 and 35 respectively and the blank then appears as shown in FIG. 3 with the inner handle panels adhered to the outer handle panels.

Figure 4:
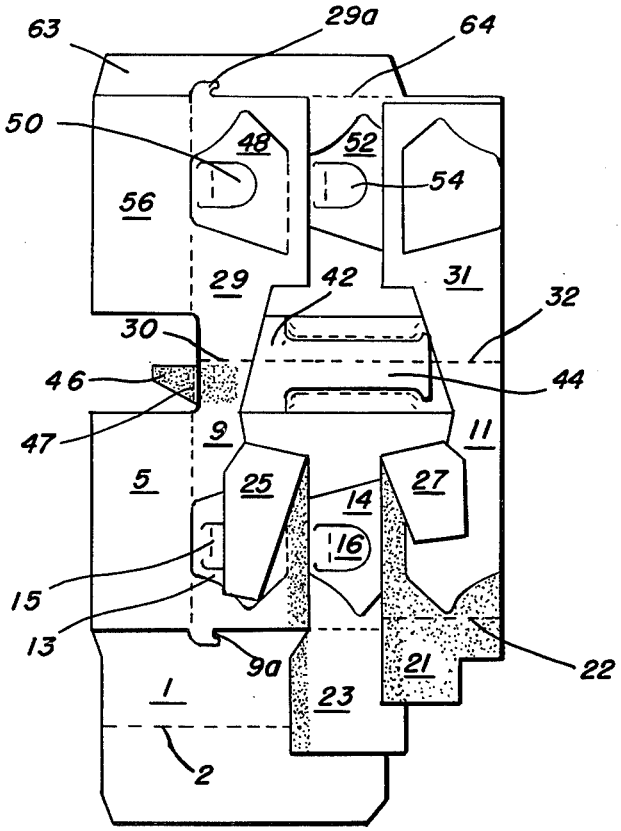

Thereafter an application of glue is made to the blank as indicated by stippling in FIG. 3 following which medial panels 11 and 31 together with transverse partition panels 14 and 52 are elevated and folded to the left along fold lines 12 and 62. This operation causes the portions of medial panels 11 and 31 which are adjacent the fold line 32 to become adhered to the right hand ends of outer handle panels 33 and 35 and also causes the anchoring tabs 16 and 54 to become adhered to side walls 4 and 58 respectively and the blank then appears as shown in FIG. 4. End wall panels 5 and 56 together with medial panels 9 and 29 and transverse partition panels 13 and 48 are then elevated and folded toward the right along fold lines 7 and 59 to occupy the positions represented in FIG. 4. This operation causes the upper ends of medial panels 9 and 29 in the region of fold line 30 to become adhered to the left hand ends of handle panels 42 and 44 and also causes the anchoring tabs 15 and 50 to become adhered to side walls 4 and 58 respectively.

An application of glue is then made to the blank as indicated by stippling in FIG. 4 following which the securing tab 46 is folded to the right along its fold line 47 and into contact with the area of medial panel 9 at fold line 30. This operation of course anchors the medial panel 9 to the handle. Simultaneously the filler panel 21 and the auxiliary filler panel 23 are elevated and folded forwardly along fold line 22 to cause the filler panel 21 to become adhered to medial panel 11 and to cause the auxiliary filler panel 23 to become adhered to the left hand edge of medial panel 11 and to the right hand edge of medial panel 9. From this operation it is clear that filler panel 21 together with auxiliary panel 27 substantially cover the opening in medial panel 11 formed when transverse partition panel 14 is struck therefrom. In addition from FIGS. 4 and 5 it is apparent that filler panel 21 and auxiliary filler panel 23 serve to interconnect the inner edges of medial panels 9 and 11 and thus provide substantial mechanical strength to the carrier. The blank then appears as shown in FIG. 5.

Figure 5:
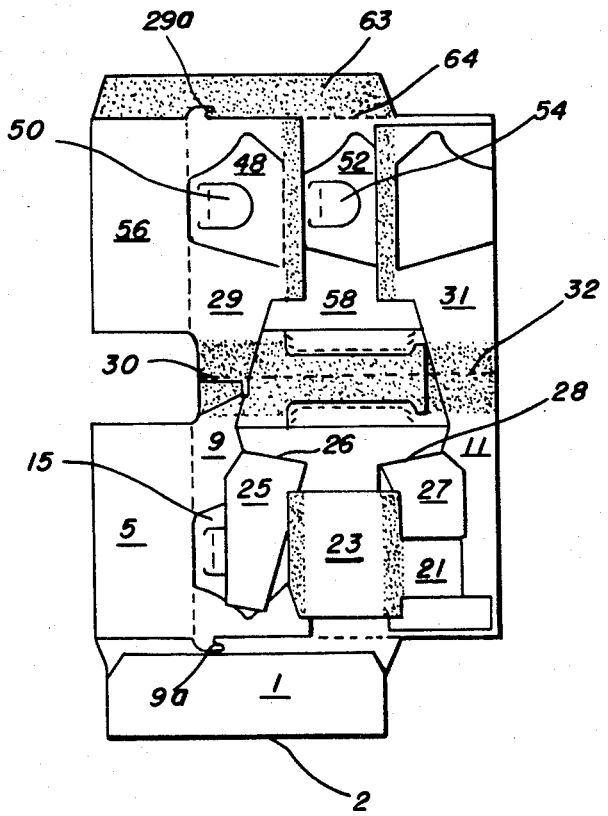
FIGS. 5 and 6 represent a completed carrier in collapsed form which when set up appears as represented in FIG. 1.
Figure 6:
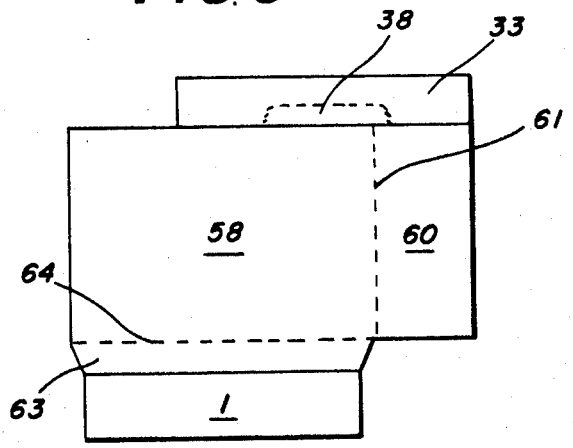

An application of glue is then made to the blank as shown in FIG. 5 after the bottom wall 1 is collapsed along its medial fold line 2 by simply folding the lower portion of bottom wall 1 as shown for example in FIG. 4 upwardly to cause the lower portion to come into flat face contacting relation with the upper portion of bottom wall 1. Thereafter those portions of the blank disposed above the fold lines 30 and 32 and which are associated with side wall 58 are elevated and folded forwardly into the collapsed condition of the carrier as shown in FIG. 6. This folding operation causes the inner surface of glue flap 63 to become adhered to the outer surface of the edge of bottom wall 1 and also causes the inner edge portions of medial panels 29 and 31 to become adhered to the side edges of auxiliary filler panel 23. In addition the portions of medial panels 29 and 31 which are adjacent the fold lines 30 and 32 become adhered to the portions of medial panels 9 and 11 which are adjacent the fold lines 30 and 32 and secures the handle panels together. The notches 9*a* and 29*a* are brought into coincidence.

The completed carrier as shown in collapsed form in FIG. 6 is easily set up into the condition represented in FIG. 1 by simply securing the side walls 4 and 58 against movement toward the left and by applying a force to the right hand edges of end wall panels 60 and 6. This operation separates the side walls 4 and 58 and causes the coincident notches 9*a* and 29*a* to receive the left hand edge of bottom wall 1 in the region of the fold line 2 so as to hold the carrier in set up locked condition.

INDUSTRIAL APPLICABILITY

By this invention a basket style carrier is provided which is particularly economical because by its construction the material required to form the carrier is minimal.

I claim:

1. An article carrier having a plurality of cells and comprising a bottom wall, a pair of side walls foldably joined respectively to the side edges of said bottom wall, end wall panels foldably joined respectively to the end edges of said side walls and extending inwardly therefrom, medial panels foldably joined respectively to the medial edges of said end wall panels at each end of the carrier and extending inwardly therefrom, said medial panels having a width greater than the width of a cell, handle structure joined to the upper portions of said medial panels, a full cell width single ply transverse partition panel struck from and foldably joined to each of said medial panels, the transverse partition panels at one end of the carrier and on opposite sides of said handle structure being initially disposed in a coplanar relationship with their associated medial panels respectively and being adapted to swing through an angle of approximately 90° during setting up of the carrier to positions extending substantially outwardly to the associated side walls and the transverse partition panels at the other end of the carrier and on opposite sides of said handle structure being initially swung out of the planes of their associated medial panels respectively through angles of approximately 180° and being adapted to swing through an angle of approximately 90° during setting up of the carrier to positions extending outwardly to the associated side walls, and an anchoring tab struck from each of said transverse partition panels and joined thereto remote from the associated medial panel and being adhered to the associated side wall.

2. An article carrier according to claim 1 wherein an auxiliary panel is foldably joined to an upper edge of each of said medial panels on one side of the carrier and is folded downwardly into overlying relation with at least a part of the associated medial panel so as to cover at least a part of the aperture formed therein when the associated transverse partition panel is struck therefrom.

3. An article carrier according to claim 1 wherein a filler panel is foldably joined to a lower edge of one of said medial panels and is folded upwardly into overlapping relation with at least a part of said one medial panel so as to cover at least a part of the aperture formed therein when the associated transverse partition panel is struck therefrom.

4. An article carrier according to claim 3 wherein an auxiliary panel is foldably joined to an upper edge of said one medial panel and is folded downwardly into overlapping relation with a part of said one medial panel so as to cover a part of said aperture.

5. An article carrier according to claim 3 wherein an auxiliary filler panel is foldably joined to said filler panel and is folded into flat face contacting relation therewith to form a part of a medial partition panel disposed underneath said handle structure.

6. An article carrier according to claim 5 wherein said auxiliary filler panel is foldably joined to said filler panel along a substantially vertical fold line.

7. An article carrier according to claim 1 wherein each of said anchoring tabs is foldably joined to the associated transverse partition panel along a fold line which is closely spaced to and substantially parallel with the outer edge of the associated transverse partition panel.

8. An article carrier according to claim 1 wherein the transverse partition panels at said other end of the carrier are swung through angles of approximately 90° in the opposite direction when the carrier is set up from the direction of folding of those panels initially.

9. An article carrier blank comprising a bottom wall, a first side wall foldably joined to a side edge of said bottom wall, a first pair of end wall panels foldably joined to the end edges of said first side wall respectively, a first pair of medial panels foldably joined respectively to the edges of said end wall panels remote from said first side wall, a second pair of medial panels foldably joined respectively along their top edges to the top edges of said first pair of medial panels, a pair of handle panels foldably joined respectively along their end edges at one end thereof with the side edges of foldably interconnected medial panels at one side of the blank, a second pair of end wall panels foldably joined respectively to the inner side edges of said second pair of medial panels, a second side wall foldably joined along its end edges to the edges of said second pair of end wall panels along the edges thereof remote from said second pair of medial panels, and a transverse partition panel having a length equal to the width of said end wall panels and struck from each of said medial panels and being hingedly connected thereto by a fold line generally parallel to and adjacent the edge of the associated medial panel remote from the adjacent end wall panel.

10. An article carrier blank according to claim 9 wherein an auxiliary panel is foldably joined to an upper edge of each of said first pair of medial panels along a diagonal fold line.

11. An article carrier blank according to claim 9 wherein a filler panel is foldably joined to one panel of said first pair of medial panels along the bottom edge of said one panel.

12. An article carrier blank according to claim 11 wherein an auxiliary filler panel is foldably joined to a side edge of said filler panel and is interposed between said bottom wall and said filler panel.

13. An article carrier blank comprising a bottom wall, a first side wall foldably joined to a side edge of said bottom wall, a first pair of end wall panels foldably joined to the end edges of said first side wall respectively, a first pair of medial panels foldably joined respectively to the edges of said end wall panels remote from said first side wall, a second pair of medial panels foldably joined respectively along their top edges of the top edges of said first pair of medial panels, a pair of handle panels foldably joined respectively along their end edges at one end thereof with the side edges of foldably interconnected medial panels at one side of the blank, a second pair of end wall panels foldably joined respectively to the inner side edges of said second pair of medial panels, a second side wall foldably joined along its end edges to the edges of said second pair of end wall panels along the edges thereof remote from said second pair of medial panels, a transverse partition panel having a length equal to the width of said end wall panels and struck from each of said medial panels and being hingedly connected thereto by a fold line generally parallel to and adjacent the edge of the associated medial panel remote from the adjacent end wall panel, an auxiliary filler panel foldably joined to an upper edge of each of said first pair of medial panels along a diagonal fold line, a filler panel foldably joined to one panel of said first pair of medial panels along the bottom edge of said one panel, and an auxiliary filler panel foldably joined to a side edge of said filler panel and interposed between said bottom wall and said filler panel.

* * * * *